United States Patent [19]

Goldstein et al.

[11] 4,118,414

[45] Oct. 3, 1978

[54] DIFLUORAMINO COMPOUNDS AND PERFLUOROGUANIDINE-PENTAERYTHRITYL NITRATES

[75] Inventors: Melvin Goldstein, Cranford; William E. Tyler, III, New Providence, both of N.J.

[73] Assignee: Exxon Research & Engineering Co., Linden, N.J.

[21] Appl. No.: 540,140

[22] Filed: Mar. 28, 1966

[51] Int. Cl.[2] ..... C07C 77/02

[52] U.S. Cl. ..... 260/467; 149/38; 149/92; 149/93; 260/564 A

[58] Field of Search ..... 260/467, 564; 149/93, 149/92, 19

[56] References Cited

U.S. PATENT DOCUMENTS

| | | | |
|---|---|---|---|
| 2,867,647 | 1/1959 | Gow et al. | 149/93 X |
| 3,228,936 | 1/1966 | Davis et al. | 260/564 X |

OTHER PUBLICATIONS

Berlow, The Pentaerythritols, Reinhold Pub. Corp., New York, 1958, pp. 65 and 66.

*Primary Examiner*—Leland A. Sebastian
*Attorney, Agent, or Firm*—Henry Berk; Jack Matalon

[57] ABSTRACT

Tris(difluoramino)methoxypentaerythrityl nitrates and perfluoroguanidine adducts of pentaerythrityl nitrates, useful as propellant ingredients, are disclosed.

5 Claims, No Drawings

DIFLUORAMINO COMPOUNDS AND PERFLUOROGUANIDINE-PENTAERYTHRITYL NITRATES

This invention was made and/or reduced to practice in the performance of Contract No. DA-30-069-ORD-2487 entered into on Dec. 1, 1958 with the Department of the Army. The Government of the United States holds an irrevocable, nonexclusive, and royalty-free license to practice, and cause to be practiced by and for the Government throughout the world, in the manufacture, use and disposition according to law, any article, material, or method embodied in any and all of the inventions disclosed in this patent application, as well as in any and all Letters Patent, for the full term or terms thereof, which may eventuate from or be based thereon.

This invention relates to new energetic compounds containing energetic tris(difluoramino)methoxy groups, $—O—C(NF_2)_3$, and nitrate groups $—ONO_2$, to the synthesis of these compounds, particularly from nitrate esters of pentaerythritol, and to determinations of the attractiveness of these new energetic compounds for use in propellants or composites used for evolving energy at controlled burning rates.

The new energetic compounds now synthesized and discovered to be useful propellant ingredients are fluorinated perfluoroguanidine adducts of pentaerythrityl mono-, di-, and trinitrates. These new energetic compounds are defined by names and compositions set forth as follows:

I. Tris(difluoramino)methoxy pentaerythrityl trinitrate $$(NF_2)_3COCH_2C(CH_2ONO_2)_3$$

Abbreviation: FA-PETRIN

II. Bis[tris(difluoramino)methoxy]pentaerythrityl dinitrate $$[(NF_2)_3COCH_2]_2C(CH_2ONO_2)_2$$

Abbreviation: FA-PEDIN

III. Tris[tris(difluoramino)methoxy]pentaerythrityl mononitrate $$[(NF_2)_3COCH_2]_3C(CH_2ONO_2)$$

Abbreviation: FA-PEMON

The abbreviated names denote that the compounds listed are derived from the trinitrate, dinitrate and mononitrate of pentaerythritol, which is the polyhydric alcohol used for preparing the high explosive known as PETN, the tetranitrate. In general, a mixture of the nitrate esters may be prepared by direct nitration of pentaerythritol by mixed sulfuric and nitric acids under controlled conditions to limit the amount of esterification of the hydroxyl groups.

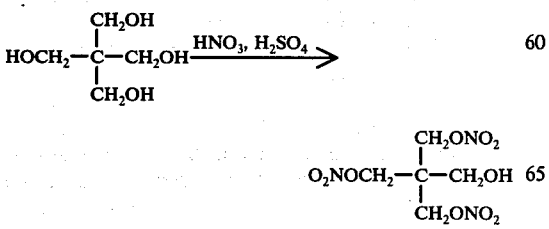

The direct nitration tends to form mixtures of the esters but is mainly useful for preparing the trinitrate.

The perfluoroguanidine (PFG) is prepared by fluorinating a salt of guanidine, e.g., guanidine carbonate, dissolved in distilled water at an adjusted pH, preferably 5 to 6, by adding aqueous HF and fluorinating in accordance with the following equation:

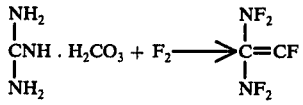

In an efficient preparation of perfluoroguanidine, sodium bifluoride was added to the solution to contain 1 mole guanidine per 1.5 moles $NaHF_2$. The product gases were collected in traps at −100° to −120° C. after which light gaseous impurities were distilled off.

Compound I is prepared by reaction of perfluoroguanidine with pentaerythrityl trinitrate which is prepared by the direct nitration of pentaerythritol.

Compound II is prepared by reaction of perfluoroguanidine with pentaerythrityl dinitrate which is prepared by:

(1) Disproportionation reaction between pentaerythritol and the tetraacetate (1:1 mole ratio)
(2) Nitration of the resulting acetate mixture
(3) Saponification of resulting nitrate-acetates.

Compound III is prepared by the reaction of perfluoroguanidine with pentaerythrityl mononitrate which is prepared similarly to the dinitrate by the use of the appropriate mole ratio of pentaerythritol to tetraacetate (3:1) in step (1).

EXAMPLES

I. Compound I — Synthesis FA-PETRIN

Six g. (40 mmoles) of PFG was charged to a reactor containing a degassed solution of 3.2 g. (12 mmoles) of pentaerythrityl trinitrate and 100 mg. of urea in 10 ml. of acetonitrile. The reaction mixture was stirred at room temperature for 20 hours. Excess PFG was vented and the solution was diluted with 25 ml. of acetonitrile and fluorinated by bubbling through a 25% $F_2/N_2$ stream at −10° for 4 hours.

The reaction mixture was then added to several volumes of water and extracted with chloroform. The chloroform extracts were washed with 5% sodium bicarbonate solution and saturated sodium chloride solution and dried over magnesium sulfate. After evaporation of most of the solvent at reduced pressure, the product was purified by chromatography on silica gel. The product was eluted with $CHCl_3/CCl_4$ mixtures. Yield 3 g. FA-PETRIN (60% on PETRIN).

Identification

Compound I was isolated as a very pale yellow oil.

Analysis — Calculated for $C_6H_8N_6F_6O_{10}$: C, 16.45%; N, 19.18%; F, 26.02%. Found: C, 16.61%; N, 18.90%; F, 26.8%.

The assigned formula of Compound I is consistent with nuclear magnetic resonance (NMR) analysis.

II. Compound II — Synthesis FA-PEDIN

Six g. (40 mmoles) of PFG was charged to a reactor containing a degassed solution of 2 g. (10 mmoles) of pentaerythrityl dinitrate (PEDIN) and 100 mg. of urea in 10 ml. of acetonitrile. The reaction mixture was stirred overnight at room temperature. The excess PFG was vented and the solution was diluted with 25 ml. of acetonitrile and fluorinated with a 25% $F_2/N_2$ stream (sub-surface bubbling) at −10° for 4 hours. Purification was effected as in Example I. Yield 2.5 g. FA-PEDIN (55% on PEDIN).

Identification

Compound II was isolated as a very pale yellow oil.

Analysis — Calculated for $C_7H_8N_8F_{12}O_8$: C, 15.01%; N, 20.00%; F, 40.7%. Found: C, 15.01%; N, 19.20%; F, 41.6%.

III. Compound III — Synthesis FA-PEMON

A reactor containing a degassed solution of 0.3 g. (1.8 mmoles) of pentaerythrityl mononitrate (PEMON) and 30 mg. of urea in 2 ml. of acetonitrile was charged with 1.1 g. (7.4 mmoles) of PFG. The reaction mixture was stirred overnight at room temperature. The excess PFG was vented and the solution was diluted with about 8 ml. of acetonitrile and fluorinated with a 25% $F_2/N_2$ stream (sub-surface bubbling) for 4 hours at −10° C. Purification was effected as in Example I. Yield 0.3 g. FA-PEMON (25% on PEMON).

Identification

Compound III was isolated as a colorless oil.

Analysis — Calculated for $C_8H_8N_{10}F_{18}O_6$: C, 14.1%; N, 20.5%; F, 50.2%. Found: C, 14.3%; N, 19.6%; F, 51.8%.

NMR analysis is consistent with the formula of Compound III.

FAPETRIN, FAPEDIN and FAPEMON are superior plasticizers for high energy solid propellant binder systems. Table I furnishes a comparison of the theoretical specific impulse obtainable with a representative propellant formulation in which only the plasticizer is varied.

TABLE I

| | Effect of Plasticizer on Isp | | | | |
|---|---|---|---|---|---|
| | TVOPA[1] | HPE[2] | FA-PETRIN | FA-PEDIN | FA-PEMON |
| HPVA-PAPI[3] | 3.6 | 3.6 | 3.6 | 3.6 | 3.6 |
| Plasticizer: | | | | | |
| TVOPA | 32.4 | | | | |
| HPE | | 32.4 | | | |
| FA-PETRIN | | | 32.4 | | |
| FA-PEDIN | | | | 32.4 | |
| FA-PEMON | | | | | 32.4 |
| FA-TNENE[4] | 59.5 | 59.5 | 59.5 | 59.5 | 59.5 |
| Boron | 4.5 | 4.5 | 4.5 | 4.5 | 4.5 |
| Isp (theor.) | 284 | 290 | 286.6 | 290.2 | 294.1 |

[1]Trivinoxypropane - $N_2F_4$ Adduct
[2]Hexakis ($NF_2$)dipropyl ether
[3]Hydrolyzed polyvinyl acetate-polyarylpolyisocyanate
[4]Flourinated PFG adduct of trinitroethylnitraminoethanol It can be seen that FAPETRIN, FAPEDIN and FAPEMON all give higher Isp's than TVOPA and that FAPEMON is superior to HPE in this respect.

Table II furnishes a comparison of the vacuum thermal stability of HPVA-PAPI plasticized with the various plasticizers.

TABLE II

| Vacuum Thermal Stability of Binders | |
|---|---|
| *9/1 HPVA-PAPI | VTS, cc/g. × 100 hours at 60° C. |
| FA-PETRIN | 0.1 |
| FA-PEDIN | 0.6 - 0.97 |
| FA-PEMON | 0.21 - 0.23 |
| TVOPA | 0 |

TABLE II-continued

| Vacuum Thermal Stability of Binders | |
|---|---|
| *9/1 HPVA-PAPI | VTS, cc/g. × 100 hours at 60° C. |
| HPE | 8 |

*Denotes 90% liquid, 10% HPVA-PAPI

It can be seen that HPE suffers from marked imcompatibility with HPVA-PAPI as shown by its poor vacuum thermal stability in the binder system. FAPETRIN, FAPEDIN, FAPEMON and TVOPA all have acceptable vacuum thermal stability when mixed with HPVA-PAPI.

Summarizing the data of Tables I and II it can be seen that:

(1) HPE, which compares favorably with subject plasticizers in Isp, has a problem of incompatibility with HPVA-PAPI.

(2) TVOPA, which has no compatibility problem, has much lower Isp than the subject plasticizers in comparable formulations.

It can be seen that the liquid FA-PETRIN which is one of the series made from the partial nitrate esters of pentaerythritol contains three nitrate and one tris(difluoramino)methoxy group and that the other members of the series, FA-PEDIN and FA-PEMON, contain less nitrate and more $OC(NF_2)_3$, and are more energetic.

FA-PETRIN is a stable liquid of low volatility. Its vapor pressure is about one-seventh that of the energetic plasticizer TVOPA. FA-PETRIN is somewhat more sensitive than TVOPA but has been handled without incident.

Availability of the three new energetic liquids, FA-PETRIN, FA-PEDIN and FA-PEMON makes feasible the preparation of solid propellants yielding theoretical impulses of 280 to 295 when used in combination with other materials, e.g., FA-TNENE which is a solid oxidizer.

Tests have shown that the energetic liquids FA-PETRIN, FA-PEDIN and FA-PEMON can be used in formulations containing ammonium perchlorate and powdered aluminum to obtain materials having high Isp values of about 290 and higher.

FA-PEMON is one of the more energetic liquid compounds so far prepared but it is more sensitive than the other compounds, FA-PETRIN and FA-PEDIN.

It is to be understood that various other formulations may be made with the herein described new oxidizers formed by the reaction of perfluoroguanidine with residual hydroxyl groups of the nitrate esters of pentaerythritol and fluorination of the perfluoroguanidine adduct resulting from said reaction.

A general formula for the new oxidizers in their purest state is:

$$[(NF_3)_3COCH_2]_mC(CH_2ONO_2)_n$$

where $m$ and $n$ are integers that add to the sum of 4. These new oxidizers are variable in their compositions depending on the number of hydroxyl groups of the parent compound esterified and reacted with $PFG/F_2$ to form the tris(difluoramino)methoxy groups, $(NF_3)_3CO$— which replace hydroxyl groups.

These high-energy liquid compounds are characterized by their compatibility with powdered metal fuels and high-energy solid binders, which makes these liquids useful in composites that are solid propellants. They may be used for other purposes where their oxidizing action is desired.

The invention described is claimed as follows:

1. Compounds which are perfluoroguanidine adducts of pentaerythrityl nitrates having residual hydroxyl groups.

2. The compound tris(difluoramino)methoxy pentaerythrityl trinitrate, having the formula:

$$(NF_2)_3COCH_2C(CH_2ONO_2)_3.$$

3. The compound bis[tris(difluoramino)methoxy]pentaerythrityl dinitrate, having the formula:

$$[(NF_2)_3COCH_2]_2C(CH_2ONO_2)_2.$$

4. The compound tris[tris(difluoramino)methoxy]-pentaerythrityl mononitrate, having the formula:

$$[(NF_2)_3COCH_2]_3C(CH_2ONO_2).$$

5. Compounds having compositions represented by the general formula: $[(NF_3)_3COCH_2]_mC(CH_2ONO_2)_n$ where $m$ and $n$ are integers that add to the sum of 4.

* * * * *